US010417884B2

(12) United States Patent
Gilmartin et al.

(10) Patent No.: US 10,417,884 B2
(45) Date of Patent: Sep. 17, 2019

(54) METHOD AND SYSTEM FOR INCIDENT SHARING IN A MONITORING SYSTEM

(71) Applicant: Apple Inc., Cupertino, CA (US)

(72) Inventors: Jessica Gilmartin, Menlo Park, CA (US); Hendrik Dahlkamp, Palo Alto, CA (US); Alexander William Teichman, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/629,385

(22) Filed: Jun. 21, 2017

(65) Prior Publication Data

US 2018/0374325 A1 Dec. 27, 2018

(51) Int. Cl.

*G08B 13/196* (2006.01)
*G08B 25/00* (2006.01)
*G08B 21/04* (2006.01)

(52) U.S. Cl.

CPC . *G08B 13/19613* (2013.01); *G08B 13/19604* (2013.01); *G08B 13/19656* (2013.01); *G08B 13/19671* (2013.01); *G08B 21/0476* (2013.01); *G08B 25/005* (2013.01); *G08B 13/19669* (2013.01)

(58) Field of Classification Search

CPC ..... G08B 25/005; G08B 13/19613; G08B 13/19604; G08B 13/19656; G08B 13/19669; G08B 21/0476; G08B 13/00; G08B 13/194; G08B 13/19671; G08K 9/007771

USPC ..... 340/937, 436, 541; 348/148, 149, 152

See application file for complete search history.

(56) References Cited

U.S. PATENT DOCUMENTS

2007/0205888 A1* 9/2007 Lee ..... G08B 13/19656 340/539.18
2010/0251109 A1* 9/2010 Jin ..... H04N 1/00153 715/273
2017/0053504 A1* 2/2017 Zhang ..... G08B 13/19613
2017/0186293 A1* 6/2017 Rabb ..... G08B 13/19656
2018/0047279 A1* 2/2018 Probin ..... G08B 25/008

* cited by examiner

*Primary Examiner* — Brian A Zimmerman
*Assistant Examiner* — Sara B Samson
(74) *Attorney, Agent, or Firm* — Kilpatrick, Townsend & Stockton

(57) ABSTRACT

In general, embodiments of the invention relate to a monitoring system used for securing an environment being monitored by the monitoring system. More specifically, one or more embodiments of the invention include a monitoring system that performs methods for detecting an incident occurring in the monitored environment.

17 Claims, 6 Drawing Sheets

METHOD AND SYSTEM FOR INCIDENT SHARING IN A MONITORING SYSTEM

BACKGROUND

Monitoring systems may be used to secure environments. A monitoring system may detect events in a monitored environment such as, for example, a person entering the monitored environment or a pet being present in the monitored environment. Upon detection of an event, the monitoring system may perform an action such as triggering an alarm, sending out a notification, etc.

SUMMARY

In general, in one aspect, the invention relates to a method for incident sharing in a monitoring system. The method includes monitoring an environment secured by the monitoring system, comprising obtaining image data of the monitored environment and detecting an event in the image data, making a first determination, by the monitoring system, that the detected event is an incident, and based on the first determination: notifying a user of the monitoring system of the incident, making a second determination that the user has requested, by operating a notification selector in a user interface that is specific to the user, a third-party to be notified of the incident, and based on the second determination: providing incident-related information to the third-party.

In general, in one aspect, the invention relates to a non-transitory computer readable medium (CRM) comprising instructions that enable a monitoring system to: monitor an environment secured by the monitoring system, comprising obtaining image data of the monitored environment and detecting an event in the image data, make a first determination, by the monitoring system, that the detected event is an incident, and based on the first determination: notify a user of the monitoring system of the incident, make a second determination that the user has requested, by operating a notification selector in a user interface specific to the user, a third-party to be notified of the incident, and based on the second determination: provide incident-related information to the third-party.

DETAILED DESCRIPTION

Figure 1:
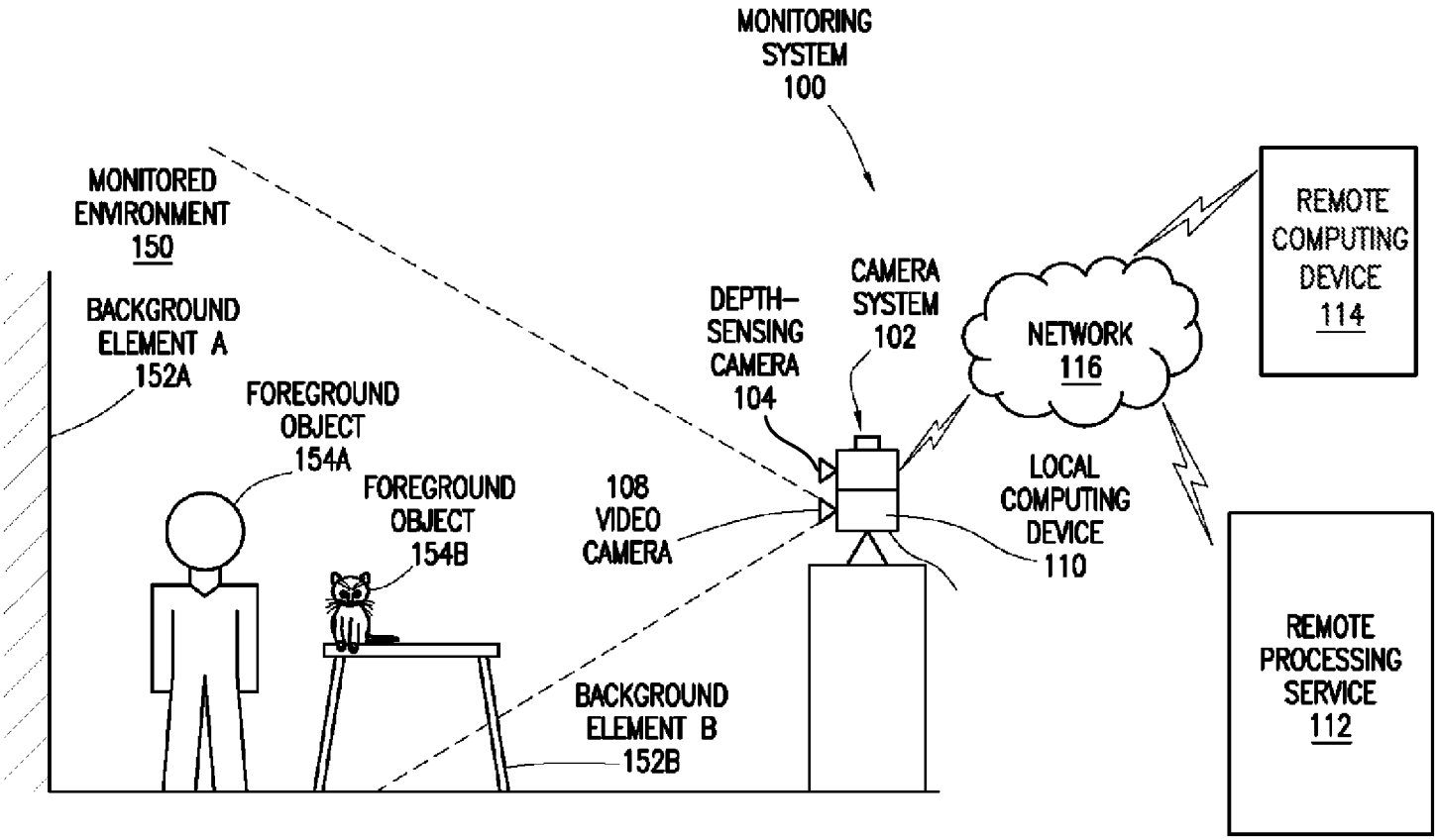
FIG. 1 shows an exemplary monitoring system, in accordance with one or more embodiments of the invention.

Specific embodiments of the invention will now be described in detail with reference to the accompanying figures. In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In the following description of FIGS. 1-6, any component described with regard to a figure, in various embodiments of the invention, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments of the invention, any description of the components of a figure is to be interpreted as an optional embodiment, which may be implemented in addition to, in conjunction with, or in place of the embodiments described with regard to a corresponding like-named component in any other figure.

In general, embodiments of the invention relate to a monitoring system used for securing an environment being monitored by the monitoring system. More specifically, one or more embodiments of the invention include a monitoring system that performs methods for detecting an incident occurring in the monitored environment. Generally, an incident, in accordance with an embodiment of the invention, is the presence or absence of a certain condition in the monitored environment. An incident may be the occurrence of an unusual event such as, for example, a burglar entering the monitored environment. An incident may further be the absence of an event, for example, if the monitoring system is employed to monitor the wellbeing of an elderly person, where a lack of activity in the monitored environment may be indicate an emergency. Those skilled in the art will recognize that an incident is not limited to the above examples. Upon detection of the incident, the monitoring system may send a notification to one or more persons. A notified person may be, for example, a user of the monitoring system, e.g., an owner of a home that is equipped with the monitoring system. The notification may enable the notified person to review information related to the incident. The notified person may, for example, review a video of the incident that triggered the notification, and/or other videos such as a live view or a recorded view of the monitored environment, to further assess the severity of the incident. Subsequently, based on, e.g., the reviewed videos associated with the incident, the notified person, in accordance with an embodiment of the invention, may decide whether an additional third-party should be notified. The additional third-party may be law enforcement, neighbors, family members, etc. The notified third-party may also receive information associated with the incident. The type of information provided to the third-party, in accordance with an embodiment of the invention, is configurable and may, for example, include a maximum amount of detail if the third-party is a law enforcement agency, but may include a limited amount of detail if the third-party is a neighbor. The detection of an incident, the notification of a user and the notification of a third-party are further described below, with reference to FIGS. 3-5.

FIG. 1 shows an exemplary monitoring system (100) used for the surveillance of an environment (monitored environment (150)), in accordance with one or more embodiments of the invention. The monitored environment may be a three-dimensional space that is within the field of view of a camera system (102). The monitored environment (150) may be, for example, an indoor environment, such as a living room or an office, or it may be an outdoor environment such as a backyard. The monitored environment (150) may include background elements (e.g., 152A, 152B) and foreground objects (e.g., 154A, 154B). Background elements may be actual backgrounds, e.g., a wall or walls of a room.

In one embodiment of the invention, the monitoring system (100) may classify certain objects, e.g., stationary objects such as a table (background element B (152B)) as background elements. Further, in one embodiment of the invention, the monitoring system (100) may classify other objects, e.g., moving objects such as a human or a pet, as foreground objects (154A, 154B). The monitoring system (100) may further classify detected foreground objects (154A, 154B) as threats, for example, if the monitoring system (100) determines that a person (154A) detected in the monitored environment (150) is an intruder, or as harmless, for example, if the monitoring system (100) determines that the person (154A) detected in the monitored environment (150) is the owner of the monitored premises, or if the classified object is a pet (154B). Alternative embodiments of the invention may not necessarily rely on the above described classification to perform a threat detection. For example, a monitoring system in accordance with an embodiment of the invention may perform threat detection based on movement detected in the monitored environment without relying on an object classification.

In one embodiment of the invention, the monitoring system (100) includes a camera system (102) and a remote computing device (112). In one embodiment of the invention, the monitoring system further includes one or more remote computing devices (114). Each of these components is described below.

The camera system (102) may include a video camera (108) and a local computing device (110), and may further include a depth sensing camera (104). The camera system (102) may be a portable unit that may be positioned such that the field of view of the video camera (108) covers an area of interest in the environment to be monitored. The camera system (102) may be placed, for example, on a shelf in a corner of a room to be monitored, thereby enabling the camera to monitor the space between the camera system (102) and a back wall of the room. Other locations of the camera system may be used without departing from the invention.

The video camera (108) of the camera system (102) may be capable of continuously capturing a two-dimensional video of the environment (150). The video camera may use, for example, an RGB or CMYG color or grayscale CCD or CMOS sensor with a spatial resolution of for example, 320×240 pixels, and a temporal resolution of 30 frames per second (fps). Those skilled in the art will appreciate that the invention is not limited to the aforementioned image sensor technologies, temporal, and/or spatial resolutions. Further, a video camera's frame rates may vary, for example, depending on the lighting situation in the monitored environment.

In one embodiment of the invention, the camera system (102) further includes a depth-sensing camera (104) that may be capable of reporting multiple depth values from the monitored environment (150). For example, the depth-sensing camera (104) may provide depth measurements for a set of 320×240 pixels (Quarter Video Graphics Array (QVGA) resolution) at a temporal resolution of 30 frames per second (fps). The depth-sensing camera (104) may be based on scanner-based or scannerless depth measurement techniques such as, for example, LIDAR, using time-of-flight measurements to determine a distance to an object in the field of view of the depth-sensing camera (104). The field of view and the orientation of the depth sensing camera may be selected to cover a portion of the monitored environment (150) similar (or substantially similar) to the portion of the monitored environment captured by the video camera. In one embodiment of the invention, the depth-sensing camera (104) may further provide a 2D grayscale image, in addition to the depth-measurements, thereby providing a complete 3D grayscale description of the monitored environment (150). Those skilled in the art will appreciate that the invention is not limited to the aforementioned depth-sensing technology, temporal, and/or spatial resolutions. For example, stereo cameras may be used rather than time-of-flight-based cameras.

In one embodiment of the invention, the camera system (102) includes a local computing device (110). Any combination of mobile, desktop, server, embedded, or other types of hardware may be used to implement the local computing device. For example, the local computing device (110) may be a system on a chip (SOC), i.e. an integrated circuit (IC) that integrates all components of the local computing device (110) into a single chip. The SOC may include one or more processor cores, associated memory (e.g., random access memory (RAM), cache memory, flash memory, etc.), a network interface (e.g., a local area network (LAN), a wide area network (WAN) such as the Internet, mobile network, or any other type of network) via a network interface connection (not shown), and interfaces to storage devices, input and output devices, etc. The local computing device (110) may further include one or more storage device(s) (e.g., a hard disk, an optical drive such as a compact disk (CD) drive or digital versatile disk (DVD) drive, a flash memory stick, etc.), and numerous other elements and functionalities. In one embodiment of the invention, the computing device includes an operating system (e.g., Linux) that may include functionality to execute the methods further described below. Those skilled in the art will appreciate that the invention is not limited to the aforementioned configuration of the local computing device (110). In one embodiment of the invention, the local computing device (110) may be integrated with the video camera (108) and/or the depth sensing camera (104). Alternatively, the local computing device (110) may be detached from the video camera (108) and/or the depth sensing camera (104), and may be using wired and/or wireless connections to interface with the local computing device (110). In one embodiment of the invention, the local computing device (110) executes methods that include functionality to implement at least portions of the various methods described below (see e.g., FIGS. 3-5). The methods performed by the local computing device (110) may include, but are not limited to, functionality to process and stream video data provided by the camera system (102) to the remote processing service (112).

Continuing with the discussion of FIG. 1, in one or more embodiments of the invention, the monitoring system (100) includes a remote processing service (112). In one embodiment of the invention, the remote processing service (112) is any combination of hardware and software that includes functionality to serve one or more camera systems (102). More specifically, the remote processing service (112) may include one or more servers (each including at least a processor, memory, persistent storage, and a communication interface) executing one or more applications (not shown) that include functionality to implement various methods described below with reference to FIGS. 3-5. The services provided by the remote processing service (112) may include, but are not limited to, functionality for: receiving and archiving streamed video from the camera system (102), identifying events in the streamed video data, determining whether an identified event may be considered an incident, etc. The services provided by the remote processing service may further include additional functionalities for notifying users and or other third parties of the occurrence of the incident and for generating a viewable documentation of the incident.

In one or more embodiment of the invention, the monitoring system (100) includes one or more remote computing devices (114). A remote computing device (114) may be a device (e.g., a personal computer, laptop, smart phone, tablet, etc.) capable of receiving notifications from the remote processing service (112) and/or from the camera system (102). A notification may be, for example, a text message, a phone call, a push notification, etc. In one embodiment of the invention, the remote computing device (114) may include functionality to enable a user of the monitoring system (100) and/or a third-party to interact with the camera system (102) and/or the remote processing service (112) as subsequently described below with reference to FIGS. 3-5. The user may, for example, receive live and/or recorded videos of the monitored environment.

The components of the monitoring system (100), i.e., the camera system(s) (102), the remote processing service (112) and the remote computing device(s) (114) may communicate using any combination of wired and/or wireless communication protocols. In one embodiment of the invention, the camera system(s) (102), the remote processing service (112) and the remote computing device(s) (114) communicate via a wide area network (e.g., over the Internet), and/or a local area network (e.g., an enterprise or home network). The communication between the components of the monitoring system (100) may include any combination of secured (e.g., encrypted) and non-secure (e.g., un-encrypted) communication. The manner in which the components of the monitoring system (100) communicate may vary based on the implementation of the invention.

Additional details regarding the monitoring system and the detection of events that is based on the distinction of foreground objects from the background of the monitored environment are provided in U.S. patent application Ser. No. 14/813,907 filed Jul. 30, 2015, the entire disclosure of which is hereby expressly incorporated by reference herein One skilled in the art will recognize that the monitoring system is not limited to the components shown in FIG. 1. For example, a monitoring system in accordance with an embodiment of the invention may not be equipped with a depth-sensing camera. Further, a monitoring system in accordance with an embodiment of the invention may not necessarily require a local computing device and a remote processing service. For example, the camera system may directly stream to a remote processing service, without requiring a local computing device or requiring only a very basic local computing device. In addition, the camera system may include additional components not shown in FIG. 1, e.g. infrared illuminators providing night vision capability, ambient light sensors that may be used by the camera system to detect and accommodate changing lighting situations, a microphone to capture audio signals, etc. Further, a monitoring system may include any number of camera systems, any number of remote processing services, and/or any number of remote computing devices. In addition, the monitoring system may be used to monitor a variety environments, including various indoor and outdoor scenarios.

Figure 2:
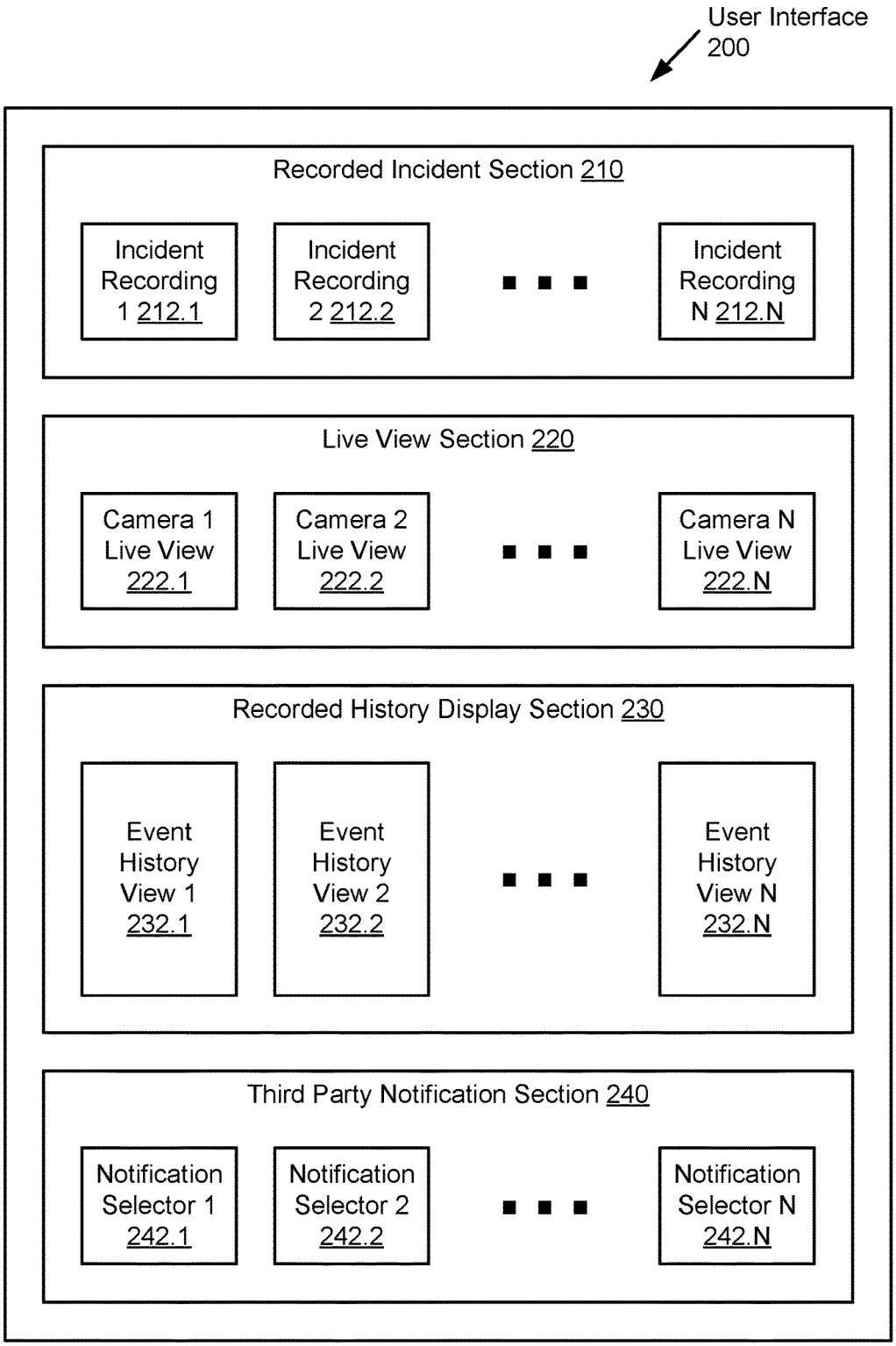
FIG. 2 shows an exemplary user interface of a monitoring system, in accordance with one or more embodiments of the invention.

FIG. 2 shows an exemplary user interface in accordance with one or more embodiments of the invention. The user interface may be an element of a standalone software application, e.g., a smartphone or tablet application, or it may be a web page that may be displayed in a web browser. The user interface may execute on a remote computing device (114) and may include functionality to enable a user of the remote computing device (114) to interact with the camera system (102) and/or the remote processing service (112). More specifically, the user interface (200) may be used to alert a user of an incident having occurred and may enable a user of the monitoring system (100) to review detected incidents, and to notify a third-party, if deemed necessary. The user may be the owner or administrator of the monitoring system or a family member, authorized to access the monitoring system. The user interface may be a software, e.g., a smartphone or tablet application or a laptop or desktop personal computer application that executes on a remote computing device. Upon notification by the monitoring system (e.g., by the remote processing service (112) or by the local computing device (110)), the user interface (200) issues an alert to the user of the remote computing device (114). The alert may be an audio alert (e.g. an alarm signal or a ringtone) a visual alert (e.g. a flashing screen or indicator light), a vibration alert, or any other type of alert that may catch the user's attention. Upon receipt of the alert, the user may access the user interface (200) to review available information related to the incident that triggered the alert. Further the user may rely on the user interface to share incident-related information with one or more third parties, e.g., law enforcement, if deemed necessary.

The exemplary user interface (200), in accordance with an embodiment of the invention includes a recorded incident section (210), a live view section (220), a recorded history section (230) and a third-party notification section (240). Each of these components is subsequently described.

The recorded incident section (210), in accordance with an embodiment of the invention, includes one or more incident recordings (212.1-212.N). An incident recording, in accordance with an embodiment of the invention, is generated when the monitoring system detects an event(s) considered to be an incident(s). Multiple incident recordings (212.1-212.N) may be available in scenarios in which multiple events that are considered incidents have been detected. For example, a first incident may be detected when a burglar enters the living room equipped with a first camera system, and a second incident may be detected when the burglar enters the bedroom equipped with a second camera system. An incident recording may display the incident, e.g., as a still image or as a video clip. Each incident recording may be accompanied by additional data. For example, a time of the incident may be reported and/or if a classification of an incident-causing object is available, this classification may be shown. The obtaining of the incident recording is further described below, with reference to FIGS. 3 and 4.

The live view section (220), in accordance with an embodiment of the invention, includes one or more camera live views (222.1-222.N). These camera live views may enable a viewing user, accessing the user interface (200), to view ongoing activities in the monitored environment. For example a user may rely on a camera live view (222.1-222.N) to determine whether a detected intruder, reported in an incident recording, is still present in the monitored environment. A camera live view (222.1-222.N) may automatically activate once the user accesses the user interface (200) or once an incident has triggered an incident recording, or it may be manually activated by the user selecting the camera live view. A camera live view may be generated from the camera signal obtained from a camera system, either immediately or with a minimum processing delay. If a monitoring system (100) includes multiple camera systems (102), multiple camera live views (222.1-222.N) may be available via the user interface (200). The user may be able to control the view, e.g., by zooming into the displayed video, by taking screen shots, etc.

The recorded history section (230), in accordance with an embodiment of the invention, includes one or more event history views (232.1-232.N). These event history views may enable a viewing user, accessing the user interface (200), to view video clips of activities that have previously occurred in the monitored environment, such as an event history associated with an incident. More specifically, a previously generated event history may be played back in an event history view. The event history may include activities that have occurred prior to the detection of an incident and/or that may have triggered the incident, and/or they may include activity that has occurred after the detection of the incident. An event history view may be associated with a particular camera system, showing an event history derived from video recordings obtained from that particular camera system. The event history may be, for example, a video recording obtained from the camera system over a certain time, starting, e.g., at a certain time prior to the detection of the incident, and/or ending at a certain time after the detection of the incident. An event history may also be incident-specific, i.e., the event history may include content that is associated with the incident. In one embodiment of the invention, an event history may be composed from video recordings obtained from multiple camera systems. Such a scenario may occur, for example, if an intruder is detected, and the intruder is captured by multiple camera systems.

In one embodiment of the invention, an event history summarizes events that have occurred in the monitored environment in a manner to quickly provide an overview of incident-related recordings, while omitting non-relevant recordings. For example, all recorded video frames that show an intruder in the monitored environment may be compiled in an event history, whereas other video frames where the intruder is not present may be dropped. Further, the time scale of the event history video may be modulated in a content-dependent manner. For example, segments that are deemed interesting, e.g., frames where an intruder is present, may be played back in real-time or slightly accelerated, whereas the playback may be significantly accelerated for other segments that are deemed less relevant. In addition, the user accessing the user interface (200) may be able to manually control the playback of an event history in an event history view.

Additional details regarding the generation of event histories are provided in U.S. patent application Ser. No. 15/132,578 filed Apr. 19, 2016, the entire disclosure of which is hereby expressly incorporated by reference herein.

In one or more embodiments of the invention, at least some of the above described elements, including the incident recordings (212.1-212.N), the camera live views (222.2-222.N) and the event history views (232.1-232.N), may also be available to third-party viewers, as further described below with reference to FIGS. 4 and 5. Third-party viewers may be able to access one or more of these elements, for example, via a web page.

Continuing with the discussion of the user interface (200), the third-party notification section (240), in accordance with an embodiment of the invention, includes one or more notification selectors (242.1-242.N). A notification selector may enable a user that accesses the user interface (200) to notify a third-party, if deemed necessary. Consider, for example, a first scenario in which the user, after viewing an incident recording (212), determines that his house is being burglarized. In response, the user activates a notification selector that contacts law enforcement to indicate an emergency situation. Further, consider a second scenario in which the user, after viewing another incident recording (212) determines that the user's dog has escaped from the guest room and managed to enter the monitored environment in the living room. In response, the user activates a notification selector (242) that contacts the neighbors to ask the neighbors to return the dog to the guest room.

A notification selector may be, for example, a push button or any other control element that may be click or touch activated, voice activated, etc. A notification selector may be preprogrammed with a contact of a third-party, e.g., a person or a group or persons to be contacted, with a method for contacting the third-party, e.g. an email address, a phone number for a voice or text message, a social network, etc., and/or with a selection of content to be shared. Content to be shared may include, but is not limited to, one or more of the incident recordings (212), one or more of the live view sections (222), one or more of the event history views (232). Depending on the receiving third-party, some or all of this content may or may not be made available to the third-party. Accordingly, each of these shared views may further be configurable, for example by specifying a degree of anonymization. Consider, for example, a live view that is being shared with law enforcement. To ensure that law enforcement can obtain a maximum degree of information, no anonymization is performed. In contrast, consider a live view that is being shared with a neighbor. In the live view, only the object or person associated with the incident but not the environment may be shown. The environment may be removed, blurred or distorted. Further, additional incident-related information may be selectively shared. For example, if an incident is reported, a time of the detected incident may be shared, and if desired, additional information may be provided. For example, a floor plan of the protected premises may be provided to law enforcement.

Figure 3:
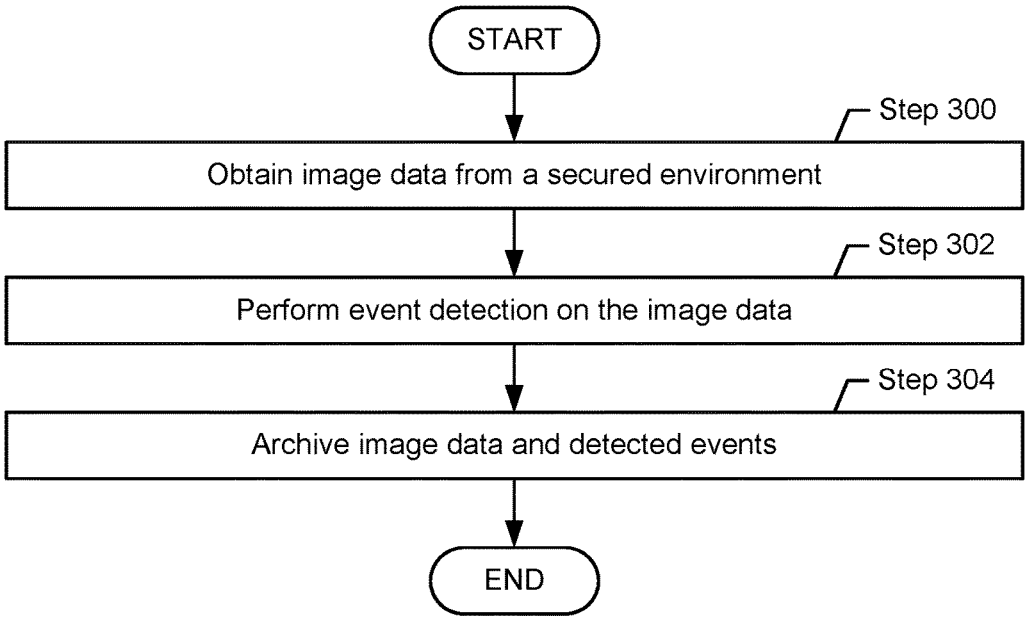
FIGS. 3-5 show flowcharts, in accordance with one or more embodiments of the invention.
Figure 4:
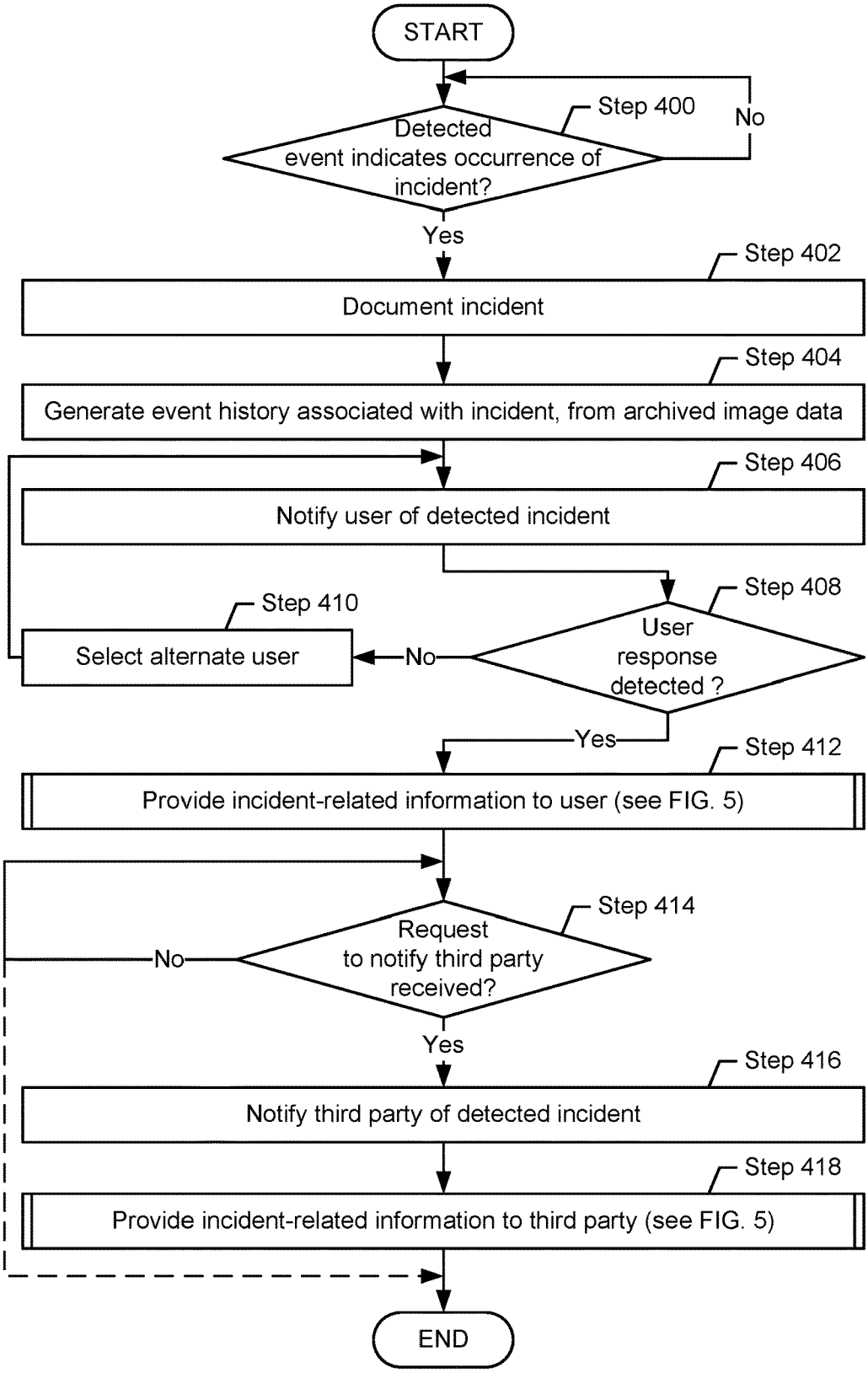
Figure 5:
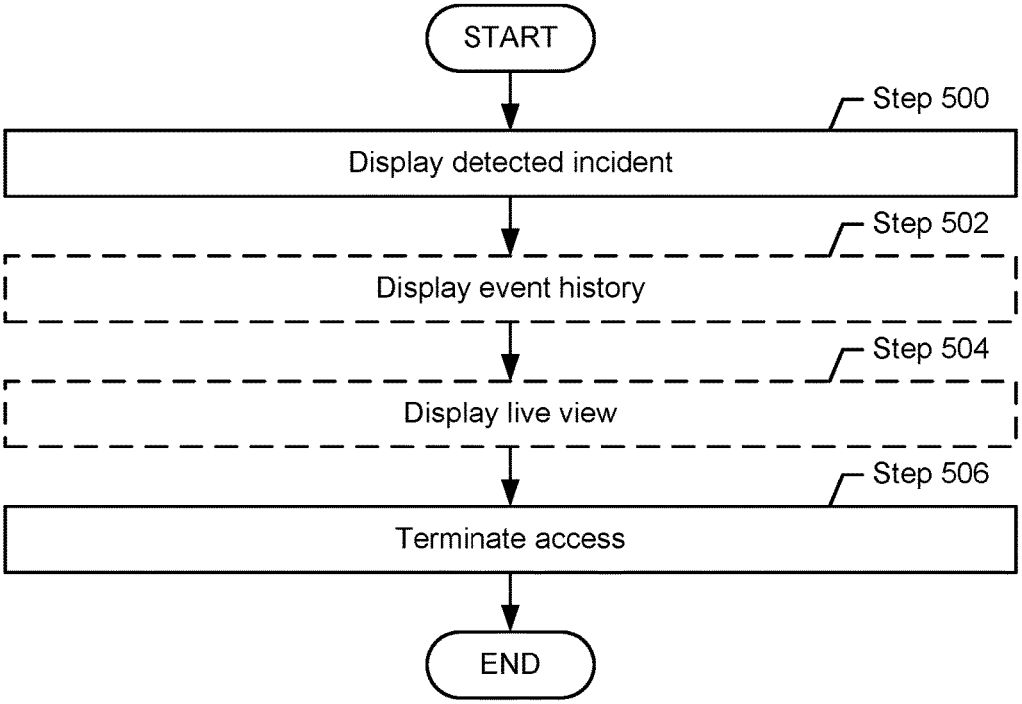

FIGS. 3-5 show flowcharts in accordance with one or more embodiments of the invention. While the various steps in the flowcharts are presented and described sequentially, one of ordinary skill will appreciate that some or all of these steps may be executed in different orders, may be combined or omitted, and some or all of the steps may be executed in parallel. In one embodiment of the invention, the steps shown in FIGS. 3-5 may be performed in parallel with any other steps shown in FIGS. 3-5 without departing from the invention.

FIG. 3 shows a method for monitoring an environment secured by an image based monitoring system. The method may continuously execute once the monitoring system is activated and may produce data relied upon by the methods described in FIGS. 4 and 5. The method may be performed by a local computing device, a remote processing service, or a combination of a local computing device and a remote processing service.

Turning to FIG. 3, in Step 300, image data is obtained from the environment that is secured by the monitoring system. The image data may be obtained from a camera system installed in the monitored environment and may include video and/or depth data.

The camera system may send an image frame to the local computing device or to the remote processing service. Image frames may be provided at regular intervals, for example, at 30 fps. A frame may include, for example, a rectangular grid of 320×240 pixels obtained by the video camera or by the depth-sensing camera. A video pixel may represent a brightness recorded in from the monitored environment. A 2D representation of the 3D monitored environment may thus be obtained using the video camera. Brightness values may be separately obtained for multiple color channels if the image provide by the video camera is a color image. A depth pixel may represent a distance from the camera to a particular point in the monitored environment. A 3D representation of the 3D monitored environment may thus be obtained using the depth-sensing camera. A grayscale or color 3D representation may be obtained if a depth-sensing camera is used in conjunction with a video camera.

In Step 302, an event detection is performed on the image data (i.e., on video and/or depth data) obtained in Step 300. The detection of an event occurrence may be based on a detection of one or more foreground objects in the video and/or depth data of the monitored environment. Movement of clusters of pixels in the video and/or in the depth data may indicate the movement of objects in the monitored environment. Based on the detection of movement, the monitoring system may distinguish foreground objects from the background of the monitored environment. An event captured in Step 302 may thus be based on the presence of one or more foreground objects in the image data obtained in Step 300. A classifier may be used to distinguish types of events. For example, a classifier may determine whether a detected foreground object is a person or a pet, being present in the monitored environment. Alternatively, the detection of an event may be directly based on the detection of movement in the video and/or in the depth data without requiring the detection of foreground objects and/or without performing a classification of detected foreground objects. Additional details regarding the distinction of foreground objects from the background of the monitored environment are provided in U.S. patent application Ser. No. 14/813,907 filed Jul. 30, 2015, the entire disclosure of which is hereby expressly incorporated by reference herein.

In one embodiment of the invention, the detection of event occurrences is performed in real-time or near-real time as the video and/or depth data of the monitored environment are received from the camera system. In one embodiment of the invention, the detection is performed by the local computing device. Alternatively, the detection may be performed by the remote processing service.

In Step 304, the image data obtained in Step 300 and/or the detected events obtained in Step 302 are archived, for example, in a non-volatile storage, e.g., on a hard disk drive, of the local computing device and/or the remote processing service. Prior to storing the image data, additional processing such as compression, format conversion, etc. may be performed. The detected events may be documented in the form of frame numbers that refer to the segments of the video and/or depth data that show the events. Alternatively, detected events may be directly stored as separate video clips of the detected events.

FIG. 4 shows a method for sharing of incident-related information with a user of the monitoring system and further for controllable and configurable sharing of the incident-related information with one or more third parties. The method may be performed by a local computing device, a remote processing service, or a combination of a local computing device and a remote processing service. In one embodiment of the invention, prior to the execution of the steps described in FIG. 4, the monitoring system is configured to recognize detected events that match a preprogrammed trigger condition. In one embodiment of the invention, an administrator of the monitoring system defines trigger conditions when setting up the monitoring system. A trigger condition, in accordance with one or more embodiments of the invention, is a condition to be met in order for an event detected in the monitored environment to be considered a trigger event, thus triggering actions, as described in FIG. 4. A trigger condition may be, for example, the detection of an unknown person in the monitored environment while the monitoring system is armed or the lack of human activity in the monitored environment during a particular time of day. In general, any event that is detectable by the monitoring system may be configured to serve as a trigger condition. Trigger conditions may be specific to the monitoring system. For example, in a monitoring system that merely detects movement, a trigger condition may be the detection of movement. In contrast, in monitoring systems that are capable of performing classifications, a trigger condition may be a particular classification. For example, if an object classification is performed, only objects that are persons may be considered trigger events. Alternatively, in monitoring systems that are capable of performing movement classifications, only the detection of a particular movement, e.g., the detected fall of an elderly person, may be considered a trigger event. Those skilled in the art will appreciate that any event that a monitoring system is capable of detecting may serve as a trigger event, if a corresponding trigger condition is set up.

A monitoring system may further be configured with multiple trigger conditions, if multiple different event occurrences warrant the notification of the user of the monitoring system. In one embodiment of the invention, trigger conditions are further configurable to adjust a trigger threshold. Consider, for example, the use of a trigger condition to detect whether an elderly person needs help. If the elderly person historically has been active in the monitored environment at least once per hour, a trigger threshold may be set to two hours of no activity in the monitored environment. Alternatively, if the elderly person historically has been less active, being registered in the monitored environment only once every five hours, the trigger threshold may be set to seven hours of no activity. A trigger threshold may be set manually, e.g., by the user of the monitoring system, or the monitoring system itself may adjust the trigger threshold based on activity patterns historically observed in the monitored environment. In addition, other trigger conditions may be imposed. For example, a trigger condition may be limited to a certain schedule, a minimum duration of an event may be required, and/or if an object is detected, the object may be required to be of a certain size, etc. Once trigger conditions are configured, the methods of FIGS. 4 and 5 may be performed.

Turning to FIG. 4, in Step 400, a determination is made about whether a detected event indicates the occurrence of an incident. The determination, in accordance with an embodiment of the invention, is performed based on data obtained in Step 302. In other words, an event detected in Step 302 is compared against pre-specified trigger conditions. An incident is detected if a detected event matches at least one of the trigger conditions.

If an occurrence of an incident is not detected, the method may remain in Step 400. If an occurrence of an incident is detected, the method may proceed to Step 402.

In Step 402, the detected incident is documented. In one embodiment of the invention, an incident is documented by tagging the frames of the image data that are associated with the event detected in Step 302 and that in Step 400 was determined to be a trigger event. The tags may indicate the beginning and the end of a sequence of frames that are associated with the incident, or they may indicate individual frames associated with the incident. The tags that document the detected incident may be stored in a database, e.g., a text file, a spreadsheet, an SQL database or any other type of hierarchical, relational and/or object oriented collection of data. The database may be stored in non-volatile or volatile memory, e.g. on a hard disk drive or in RAM. Alternatively, the detected incident may be documented by storing the associated frames in a separate video clip being generated from these frames.

In Step 404, an event history, associated with the detected incident, is generated from the image data that was archived in Step 304. The event history may include activities that have occurred prior to the detection of the incident and that may have led to the incident, and/or they may include activities that have occurred after the detection of the incident. At a later time, e.g. as described in FIG. 5, the event history may be displayed to a user of the monitoring system or to a third-party.

As previously described, an event history may be generated in a camera-specific manner, i.e., an event history may be generated for a particular camera of the monitoring system. An event history may further be generated in an incident-specific manner, i.e., one event history may be generated to document events before and/or after the occurrence of a specific incident. Further, an event history may be established in a manner to summarize segments of the image data deemed relevant while skipping segments deemed non-relevant. Details regarding the generation of event histories are provided in U.S. patent application Ser. No. 15/132,578, as previously noted.

In one embodiment of the invention, an event history is generated by tagging the frames of the image data that are to be included in the event history. The tags that document the detected incident may be stored in a database, e.g., a text file, a spreadsheet, an SQL database or any other type of hierarchical, relational and/or object oriented collection of data. The database may be stored in non-volatile or volatile memory, e.g. on a hard disk drive or in RAM. Alternatively, the event history may be stored ad a video generated from the tagged frames.

In Step 406, a user of the monitoring system is notified. The notified user may be the administrator of the monitoring system, an owner of the monitoring system, a family member, etc. A list of users to be contacted may be established as part of the configuration of the monitoring system, and multiple users may thus be notified. The notification may be provided as an alert of the previously described user interface. Alternatively or additionally alerts may be provided via phone calls, text messages, social media networks, etc. Those skilled in the art will appreciate that any type of notification that alerts the user of the incident may be relied upon without departing from the invention. Upon receiving the alert, the user may access the user interface of the monitoring system to obtain additional details related to the incident.

In Step 408, a determination is made about whether a user response was detected. A user response may be detected based on whether the user responds to the notification, e.g. by accessing the user interface of the monitoring system. If no user response is detected, the method may proceed to Step 410, whereas if a user response is detected, the method may proceed to Step 412.

In Step 410, an alternate user to be notified is selected and may subsequently be notified upon repetition of Step 406. An alternate user to be notified may be selected from the list of users to be notified. Steps 406-410 may be repeated until a user response is detected.

In Step 412, information associated with the incident is provided to the user. The information being provided may include one or more of the previously described incident recordings, camera live views and/or one or event history views. The details of Step 412 are described below, with reference to FIG. 5.

In Step 414, a determination is made about whether a request to notify a third-party was received. A request to notify a third-party may be generated by a user that activates a notification selector in the user interface of the monitoring selection. A user may choose to notify one or more third parties. As previously discussed, a notification selector may be preconfigured to notify a particular third-party or third parties.

In Step 416, the third-party selected in Step 414 is notified of the detected incident. In one embodiment of the invention the notification includes a universal resource locator (URL). The URL may be provided to the third-party, e.g., via a phone call, a text message, a social network notification, etc. Those skilled in the art will recognize that the URL may be provided to the third-party in any way, without departing from the invention. The URL, in accordance with an embodiment of the invention, directs the third-party to incident-related content as subsequently described. The URL may identify the resource to be accessed using simple, easy-to-remember elements such as, for example, a telephone number, and address etc. Such a URL may be, for example www.alarm-monitoring.com/123-456-7890. Multiple third parties may be notified, as previously described in Step 414. If multiple third parties are notified, these third parties may receive the same or different URLs. Different URLs may be used if different information related to the incident is to be shared with different third parties, as subsequently described with reference to FIG. 5.

In Step 418, information associated with the incident is provided to the third-party. The information may be provided as the third-party accesses the content identified by the URL provided in Step 416, as described below with reference to FIG. 5. The content may include one or more incident recordings, one or more camera live views and/or one or more event history views, depending on what resources are made available to the third-party.

FIG. 5 shows a method for providing incident-related information to a user of the monitoring system or to a third-party. The incident-related information may be provided via a stand-alone application executing on a remote computing device or via a web page hosted by a browser on a remote computing device. In one embodiment of the invention, a user of the monitoring system accesses incident-related information via the stand-alone application that provides a user interface to the monitoring system, whereas a third-party, not having access to such an application, accesses the incident-related information via a webpage, as instructed by the URL provided in Step 416. Prior to being able to access incident-related information, as described in Steps 500-506, the user or third-party may be required to enter credentials. Further, while viewing the incident-related information, the user or third-party may be able to enter credentials to gain access to otherwise not available incident-related information. For example, without providing credentials, only an anonymized version of a camera live view may be available, whereas a complete version of the camera live view may become available after entering the credentials.

In Step 500, the detected incident is displayed to the user or to the third-party. Video frames that were obtained as previously described in Step 402 may be played back, either automatically, e.g., as soon as the user or third-party responds to the notification provided in Step 416, or upon request, e.g., when the user/third-party clicks a play button. Review of the detected incident may enable the user/third-party to assess the severity of the incident. In one embodiment of the invention, the content being displayed in Step 500 varies depending on the identity of the user or the third-party. While a user of the monitoring system may receive a complete video of the incident, a third-party may receive a redacted version of the video. For example, in a monitoring system that uses object classification for the incident detection, only the object (e.g., an intruder), but not the background, is shown. Alternatively, the background and/or other objects may be blurred, occluded, etc. What level of detail is displayed to a particular user and/or third-party, in accordance with an embodiment of the invention, is configurable. Different URLs may be provided to different users and/or third parties to provide access to different levels of detail, e.g., based on. Additionally or alternatively, different credentials may be provided to different users/third parties to grant access to different levels of detail.

In Step 502, the event history, associated with the detected incident, is displayed. The event history may be displayed in in an event history view of the user interface, accessed by a user of the monitoring system and/or in any other application or web browser-based interface, accessed, e.g., by a third-party. Review of the event history may enable the user/third-party to potentially understand events that have led to the incident and/or events that have occurred after the incident. In one embodiment of the invention, the execution of Step 502 is optional. For example, a user may always be able to access the event history, whereas only selected third parties may be able to access the event history. Law enforcement may be a third-party that has access to the event history, whereas a neighbor may be a third-party that does not have access to the event history. Further, different versions of the event history with various degrees of anonymization and/or occlusion of details may be made available, depending on the identity of the viewing user or third-party. As previously described, the level of detail that is available to a particular user and/or third-party, in accordance with an embodiment of the invention, is configurable and may be specified in the configuration of the monitoring system. Further, an event history may automatically play back once the user interface or webpage is accessed, or playback may be manually activated by the user. Controls may enable the user/third-party to replay, modify playback speed, zoom into the event history, etc.

In Step 504, one or more live views are displayed. A live view may be displayed in a live camera view of the user interface, accessed by a user of the monitoring system and/or in any other application or web browser-based interface, accessed, e.g., by a third-party. Review of the live view may enable the user/third-party to view ongoing activities in the monitored environment. In one embodiment of the live view may be altered, depending on the identity of the user or the third-party. While a user of the monitoring system may receive the original live view, as captured by the corresponding camera system, a third-party may receive a redacted version of the live view. For example, areas may be partially occluded or blurred. What level of detail is displayed to a particular user and/or third-party, in accordance with an embodiment of the invention, is configurable in a user/third-party-dependent manner, as previously discussed. In one embodiment of the invention, the execution of Step 504 is optional. For example, the user may be able to see the live view, whereas only selected third parties may be able to see the live view. For example, law enforcement may be able to see a complete live view, whereas neighbors may not have the option to see a live view at all, or a live view that has been partially anonymized, blurred and/or occluded. A live view may automatically display once the user interface or webpage is accessed, or it may be manually activated by the user of the monitoring system or the third-party. Further, controls may enable the user/third-party to replay, modify playback speed, zoom into the event history, etc.

In Step 506, the access to the incident-related information is terminated. The access may be terminated, for example, by invalidating the URL provided to the third-party. A notification that the access has been terminated may or may not be provided. The access may be terminated, after a certain time, after some or all of the incident-related information has been accessed, when the user provides instructions to terminate access, etc.

The subsequently described use case scenarios are intended to provide examples of the method for incident sharing, described in FIGS. 3-5. The use case scenarios are for illustrative purposes only. The methods described by FIGS. 3-5 are not limited to the use case scenarios.

Consider a scenario in which the monitoring system is used to protect a home. Accordingly, the monitoring system is configured to treat the presence of a person in the monitored environment as an incident, when armed. The monitoring system is further configured to notify the owner when the incident is detected. Further, the monitoring system is configured with the information necessary to contact the neighbors and law enforcement. The neighbors' telephone number is stored in the configuration of the monitoring system, thus enabling the monitoring to send a text message to the neighbors, if requested by the user. The text message to be sent includes the universal resource locator (URL) "www.alarm-monitoring.com/please_check_89_michigan_ave". Further, the telephone number of the local police is stored in the configuration of the monitoring system, thus enabling the monitoring system to play a pre-recorded voice message to the local police. The voice message includes the universal resource locator (URL) "www.alarm-monitoring.com/emergency_89_michigan_ave". The owner leaves for a vacation and arms the monitoring system. One day, an intruder enters the monitored premises and is detected by the monitoring system. The monitoring system alerts the user via a smartphone alarm. The user, while on vacation, opens the user interface of the monitoring system and reviews the incident recording which shows the intruder in the living room. The user immediately activates a first notification selector in the user interface, programmed to call local law enforcement. Further, the user also activates a second notification selector in the user interface, programmed to notify the neighbors. While the neighbors are not responding to the notification because they are also on vacation, the notification is received at the local police station. A police officer reviews the webpage addressed by the URL www.alarm-monitoring.com/emergency_89_michigan_ave, and based on the incident recording determines that the house equipped with the monitoring system is being burglarized. As the police officer reviews an available live camera view, he further discovers that the burglar is still present. An armed unit is immediately sent to the house to address the situation. Through the live view the burglar is continuously monitored as the armed unit is on the way to the house.

Further, consider a second scenario in which a monitoring system is installed inside the home of an elderly person. The monitoring system is intended to detect emergencies based on a lack of activity by the elderly person. The monitoring system is configured to notify the son of the elderly person when an incident (i.e., a lack of activity by the elderly person) is detected. Further, the monitoring system has been configured with the information necessary to contact a local caretaker and local emergency services (911). One day, the camera system that monitors the living room of the elderly person detects a complete absence of activity in the living room for a prolonged time. The monitoring system alerts the son via a smartphone alarm. The son is out of town, thus being unable to check on the elderly person, and therefore immediately notifies the caretaker by activating a first notification selector that is programmed to contact the caretaker. After notifying the caretaker, the son further reviews the event history and live view provided via the user interface of the monitoring system. In the event history generated from a camera system installed in the bedroom, the son notices that the elderly person has been in bed, entirely motionless for multiple hours. Upon this finding, the son further activates a second notification selector that is programmed to contact 911.

Figure 6:
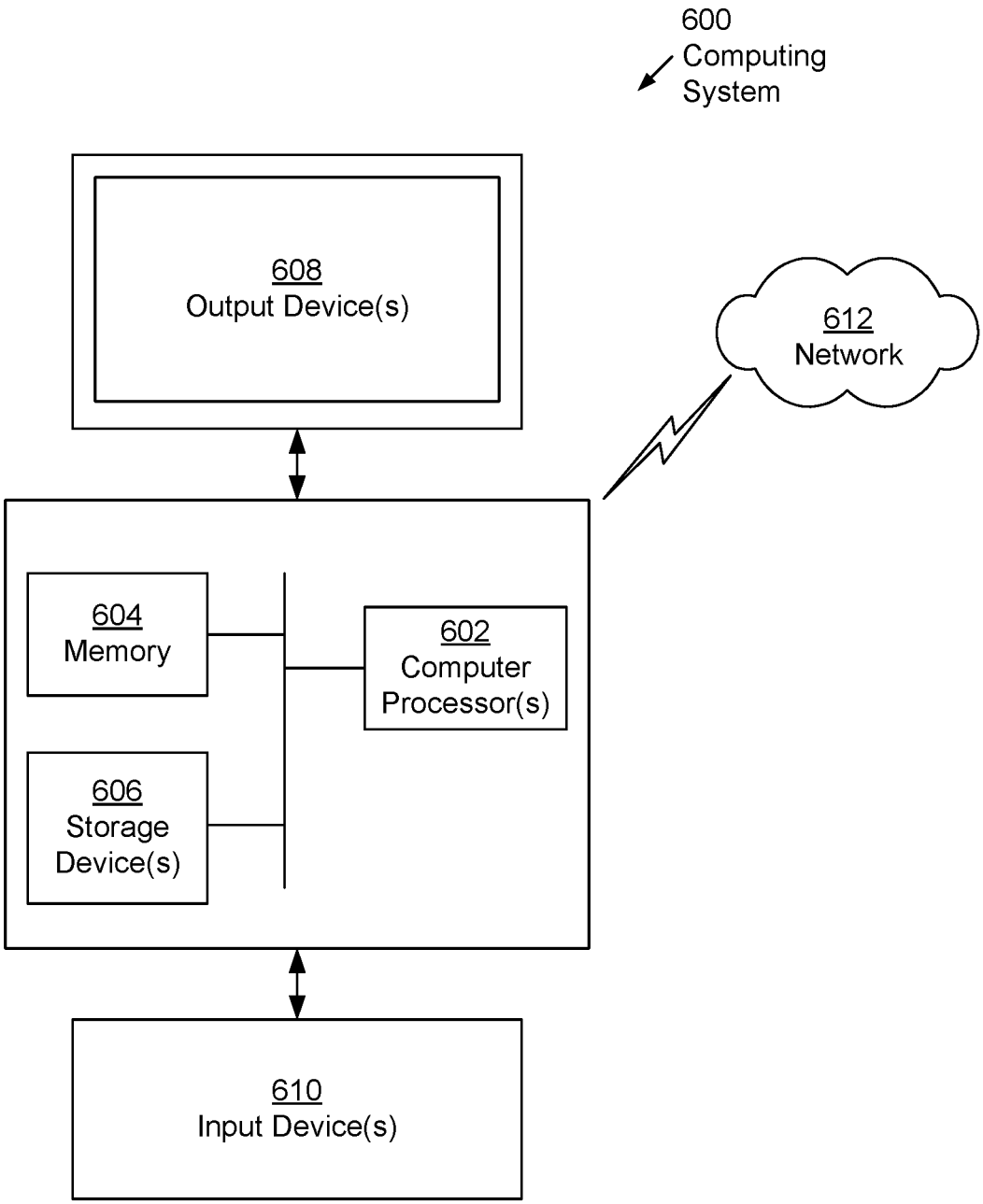
FIG. 6 shows a computing system, in accordance with one or more embodiments of the invention.

Embodiments of the technology may be implemented on a computing system. Any combination of mobile, desktop, server, embedded, or other types of hardware may be used. For example, as shown in FIG. 6, the computing system (600) may include one or more computer processor(s) (602), associated memory (604) (e.g., random access memory (RAM), cache memory, flash memory, etc.), one or more storage device(s) (606) (e.g., a hard disk, an optical drive such as a compact disk (CD) drive or digital versatile disk (DVD) drive, a flash memory stick, etc.), and numerous other elements and functionalities. The computer processor (s) (602) may be an integrated circuit for processing instructions. For example, the computer processor(s) may be one or more cores, or micro-cores of a processor. The computing system (600) may also include one or more input device(s) (610), such as a touchscreen, keyboard, mouse, microphone, touchpad, electronic pen, or any other type of input device. Further, the computing system (600) may include one or more output device(s) (608), such as a screen (e.g., a liquid crystal display (LCD), a plasma display, touchscreen, cathode ray tube (CRT) monitor, projector, or other display device), a printer, external storage, or any other output device. One or more of the output device(s) may be the same or different from the input device(s). The computing system (600) may be connected to a network (612) (e.g., a local area network (LAN), a wide area network (WAN) such as the Internet, mobile network, or any other type of network) via a network interface connection (not shown). The input and output device(s) may be locally or remotely (e.g., via the network (612)) connected to the computer processor(s) (602), memory (604), and storage device(s) (806). Many different types of computing systems exist, and the aforementioned input and output device(s) may take other forms.

Software instructions in the form of computer readable program code to perform embodiments of the technology may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform embodiments of the technology.

Further, one or more elements of the aforementioned computing system (600) may be located at a remote location and connected to the other elements over a network (612). Further, embodiments of the technology may be implemented on a distributed system having a plurality of nodes, where each portion of the technology may be located on a different node within the distributed system. In one embodiment of the technology, the node corresponds to a distinct computing device. Alternatively, the node may correspond to a computer processor with associated physical memory. The node may alternatively correspond to a computer processor or micro-core of a computer processor with shared memory and/or resources.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for incident sharing, the method comprising:
monitoring, by a monitoring device, an environment secured by a monitoring system, the monitoring comprising:
obtaining, by the monitoring device, image data of the monitored environment; and
detecting, by the monitoring device, an event in the image data;
making a first determination that the detected event is an incident;
based at least in part on the first determination:
notifying a user of the monitoring system about the incident;
making a second determination, based at least in part on a user request, that at least two different third-parties are to be notified of the incident; and
based at least in part on the second determination:
generating a first video of the incident that is not altered and a second video of the incident that is altered to not include the background of the monitored environment;
providing a first credential for accessing the first video to a first third-party of the at least two different third-parties; and
providing a second credential for accessing the second video to a second third-party of the at least two different third-parties.

2. The method of claim 1, wherein making the first determination comprises determining that the detected event matches a pre-specified trigger condition, and wherein the trigger condition comprises at least one of a presence of a condition in the monitored environment or an absence of the condition in the monitored environment.

3. The method of claim 2, wherein the condition is at least one of a movement of a particular class or an object of a particular class.

4. The method of claim 1, wherein notifying the user of the monitoring system comprises:
sending an alert to the user, via at least one of a user interface, a phone call, a text message, or a social media network notification; and
providing an incident recording video to the user.

5. The method of claim 4, wherein notifying the user of the monitoring system further comprises providing, to the user, at least one of an event history or a live view.

6. The method of claim 1, further comprising:
invalidating a first URL for accessing the first video or a second URL for accessing the second video based at least in part on at least one of a passage of time, a determination that the first video or the second video have been accessed, or an instruction, from the user, to terminate access to the first video or the second video.

7. The method of claim 1, wherein the alteration of the second video further comprises at least one of a blurring of at least one region in the monitored environment or an occlusion of at least one region of the monitored environment.

8. A non-transitory computer readable medium (CRM) comprising instructions that enable a monitoring system to:

monitor an environment secured by the monitoring system, the monitoring comprising:

obtaining image data of the monitored environment; and detecting an event in the image data;

make a first determination, by the monitoring system, that the detected event is an incident;

based at least in part on the first determination:

notify a user of the monitoring system about the incident;

make a second determination, based at least in part on a user request, that at least two different third-parties are to be notified of the incident; and based at least in part on the second determination:

generate a first video of the incident that is not altered and a second video of the incident that is altered to not include the background of the monitored environment;

provide a first credential for accessing the first video to a first third-party of the at least two different third-parties; and provide a second credential for accessing the second video to a second third-party of the at least two different third-parties.

9. The non-transitory CRM of claim 8, wherein making the first determination comprises determining that the detected event matches a pre-specified trigger condition, and wherein the trigger condition comprises at least one of a presence of a condition in the monitored environment or an absence of the condition in the monitored environment.

10. The non-transitory CRM of claim 9, wherein the condition at least one of a movement of a particular class, and or an object of a particular class.

11. The non-transitory CRM of claim 8, wherein notifying the user of the monitoring system comprises:

sending an alert to the user, via at least one of a user interface, a phone call, a text message, or a social media network notification; and providing an incident recording video to the user.

12. The non-transitory CRM of claim 11, wherein notifying the user of the monitoring system further comprises providing, to the user, at least one of an event history or a live view.

13. A monitoring system, comprising:

a memory for storing computer-readable instructions; and one or more processors for executing the computer-readable instructions to at least:

monitor an environment secured by the monitoring system, the monitoring comprising:

obtaining image data of the monitored environment; and detecting an event in the image data;

make a first determination, by the monitoring system, that the detected event is an incident;

based at least in part on the first determination:

notify a user of the monitoring system about the incident;

make a second determination, based at least in part on a user request, that at least two different third-parties are to be notified of the incident; and based at least in part on the second determination:

generate a first video of the incident that is not altered and a second video of the incident that is altered to not include the background of the monitored environment;

provide a first credential for accessing the first video to a first third-party of the at least two different third-parties; and provide a second credential for accessing the second video to a second third-party of the at least two different third-parties.

14. The system of claim 13, wherein making the first determination comprises determining that the detected event matches a pre-specified trigger condition, and wherein the trigger condition comprises at least one of a presence of a condition in the monitored environment or an absence of the condition in the monitored environment.

15. The system of claim 14, wherein the condition at least one of a movement of a particular class or an object of a particular class.

16. The system of claim 13, wherein notifying the user of the monitoring system comprises:

sending an alert to the user, via at least one of a user interface, a phone call, a text message, or a social media network notification; and providing an incident recording video to the user.

17. The system of claim 16, wherein notifying the user of the monitoring system further comprises providing, to the user, at least one of an event history or a live view.

* * * * *